US006564906B1

(12) United States Patent
Haack et al.

(10) Patent No.: US 6,564,906 B1
(45) **Date of Patent: *May 20, 2003**

(54) INDUSTRIAL DELIVERY TRUCK, IN PARTICULAR PICKUP-AND-DELIVERY DEVICE

(75) Inventors: Wolfgang Haack, Hamburg (DE); Michael Niebuhr, Bargteheide (DE)

(73) Assignee: Steinbock Boss GmbH Fordertechnik, Moosburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/526,241

(22) Filed: Mar. 15, 2000

Related U.S. Application Data

(63) Continuation of application No. PCT/EP98/07145, filed on Nov. 11, 1998.

(30) Foreign Application Priority Data

Nov. 10, 1997 (DE) ..... 197 49 679

(51) Int. Cl.[7] ..... B66F 9/06

(52) U.S. Cl. ..... 187/222

(58) Field of Search ..... 187/222, 224, 187/298, 306, 414

(56) References Cited

U.S. PATENT DOCUMENTS

| | | | | |
|---|---|---|---|---|
| 4,471,848 A | | 9/1984 | Skytoen | 180/90 |
| 4,566,599 A | * | 1/1986 | Villa et al. | |
| 5,022,496 A | * | 6/1991 | Klopfleisch et al. | 187/224 |
| 5,044,472 A | | 9/1991 | Dammeyer et al. | 187/9 |
| 5,409,079 A | * | 4/1995 | Strong et al. | 180/326 |
| 5,839,542 A | | 11/1998 | Seng et al. | 187/222 |
| 5,890,562 A | * | 4/1999 | Bartels et al. | 187/224 |

FOREIGN PATENT DOCUMENTS

| | | | | |
|---|---|---|---|---|
| DE | 8700166 | | 3/1988 | |
| DE | 19518116 | | 11/1995 | |
| DE | 4437568 | | 1/1996 | |
| EP | 0555025 | | 8/1993 | |
| GB | 2289669 | | 11/1995 | |
| GB | 2325211 | * | 11/1998 | 187/224 |
| JP | 406092560 | * | 4/1994 | 187/414 |

OTHER PUBLICATIONS

Derwent abstract, "Changeover System for Crane . . . Seat Movable Between Consoles . . . ", published Dec. 19, 1979.*

BT Product Information, OPAL OM/OMW, 1996.

How to Pick It, *Materials Handling News*, Jul. 1977, pp. 26–27.

* cited by examiner

*Primary Examiner*—Robert P. Olszewski
*Assistant Examiner*—Steven B. McAllister
(74) *Attorney, Agent, or Firm*—Baker Botts L.L.P.

(57) ABSTRACT

There is disclosed a pickup-and-delivery vehicle having a controllable travel mechanism, which has a load-carrying means movable vertically on a lifting framework, a driver's cab movable vertically on the lifting framework together with the load-carrying means and an operating panel to be operated from the driver's cab. Separate function regions of the operating panel are designed as modules separable from one another, of which at least one in the access region of the driver's cab is repositionable between at least two operating positions from one side of the driver's cab to another side of the driver's cab and is capable of functional use in each of these operating positions.

9 Claims, 6 Drawing Sheets

INDUSTRIAL DELIVERY TRUCK, IN PARTICULAR PICKUP-AND-DELIVERY DEVICE

CROSS REFERENCE TO RELATED APPLICATION

This application is a continuation of PCT International Application PCT/EP98/07145 filed Nov. 11, 1998.

BACKGROUND

1. Field of the Invention

The invention relates to an industrial delivery truck, in particular a pickup-and-delivery device, as a vehicle having a controllable travel mechanism, a load-carrying means controlled vertically movable on a lifting framework, a driver's cab, in particular movable vertically on the lifting framework together with the load-carrying means, and an operating panel, to be operated from the driver's cab, for controlling the travel mechanism and lifting functions of the load-carrying means, where the operating panel has at least two function regions, of which a first one is provided for operation chiefly by the left hand and a second one is provided for operation chiefly by the right hand of an operator in the driver's cab.

2. The Prior Art

Industrial delivery trucks of the type described above are used in a variety of applications, including as pickup devices, in which a cabin with driver's cab for an operator is capable of being moved vertically on a lifting framework. Arranged at the front of the cabin is a load-carrying means, for example a pair of forks pointing forward in the longitudinal direction of the vehicle, which is controlled vertically movable together with the driver's cabin and, in addition, relative to the driver's cabin. An operator standing in the cabin has available an operating panel that has operating elements for controlling the travel mechanism and the lifting functions as well as optionally a steering means. With it, the operator can selectively set forward travel operation or backward travel operation, control the speed of travel as well as the common lift of the cabin and the load-carrying means (main lift) and the lift of the load-carrying means relative to the cabin (supplementary lift), in order, for example, to steer to specific positions on a shelf in a warehouse, so that the operator can remove goods from the shelf from the cabin and place them over a front breastwork of the cabin on the load-carrying means or on a pallet carried thereon.

In known pickup-and-delivery devices of the type described above, the operating panel is mounted in a rear region of the cabin in the longitudinal direction of the vehicle, namely on the rear wall of the cabin. The operator then stands at the controls of the travel mechanism or lift operation of the pickup-and-delivery device in the cabin so that the operator's body is positioned essentially to the rear of the vehicle. The lifting framework and the cabin have regions open toward the rear, which permit the operator a view straight ahead in backward travel.

The operator is able to observe the lifting functions of the load-carrying means when, starting from the posture described above, he turns his upper body or his head to the front of the cabin. Such an operating configuration may be useful when, in the typical use of the pickup-and-delivery device long stretches without an intermediate stop are to be covered more often in backward travel operation than in forward travel operation, as may be the case, for example, in backward travel in an aisle of shelves with the completed assembly of a pickup after the shelf positions concerned have been approached for assembly of the pickup stepwise in forward travel operation.

However, if in some other use situation of the pickup-and-delivery device forward travel operation is the main travel operation, in which for example regular higher travel speeds are possible, arrangement of the operating panel at the rear of the driver's cabin is ergonomically unfavorable, and safety aspects are also affected.

A brochure of the firm of BT Products AB, Sweden, under the title "BT Production Information PAL OM/OMW", 1996, describes a pickup-and-delivery device in which the operating panel or operating console as a whole can be shifted from the rear inside of the cabin to the front inside of the cabin. For operating the operating panel shifted to the front, the operator stands with his body positioned toward the front in the cabin. The operating configuration last mentioned may be useful when forward travel is the principal travel operation, i.e., long stretches are to be covered without interruption more frequently in forward travel operation than in backward travel operation.

However, there are also situations of use in which frequent changes in the direction of travel and intermediate lifting operations of the pickup-and-delivery device are required, such as in searching runs in an aisle of shelves for assembly of a pickup of numerous small parts. In such case, none of the arrangements mentioned above provides optimal ergonomic conditions for the operator in controlling the pickup-and- delivery means. In frequent runs in the direction opposite the side of the cabin on which the operating panel is provided, the operator then each time has to assume a posture essentially with his upper body and/or head turned toward the rear in order to be able to observe the behavior of the vehicle in the direction of travel and look for shelf positions to be approached.

SUMMARY

An object of the invention is to provide an industrial delivery truck, in particular a pickup-and-delivery device, of the kind mentioned at the beginning that permits more operating configurations, and hence more ergonomic performance of tasks, for the operator in various situations of use of the pickup-and-delivery device.

In accordance with the invention, this object is attained in an industrial delivery truck with the features mentioned at the beginning, by designing the two function regions as modules separable from one another, in which at least one module in the access region of the driver's cab is repositionable between at least two operating positions from one side of the driver's cab to another side of the driver's cab and is capable of functional use in each of these operating positions.

For example, in a use situation in which backward travel is the main travel operation, in which, for example, higher travel speeds are possible, both modules of the operating panel may be arranged in the rear region of the driver's cab, preferably on the rear wall of a driver's cabin.

If forward travel is the main travel operation for the industrial delivery truck, it may be advantageous to arrange both modules in the front region of the cabin.

However, a very useful possibility is obtained, in accordance with the invention, in that one of the modules may be arranged in the front region of the driver's cab and the other module in the rear region of the driver's cab. For operation of the two modules, the operator can now stand in the driver's cab facing transverse to the longitudinal direction of the vehicle. Such a posture is a very good compromise in certain use situations of the industrial delivery truck from an ergonomic viewpoint, as, for example, when frequent changes in the direction of travel after short stretches of travel in each instance and numerous lifting motions are required in searching runs in an aisle of shelves. Then, the operator, by corresponding positioning of his head and without much turning of his upper body, can survey a large visual range including the two opposite directions of travel and direct his sight to shelf positions of an opposite shelf.

The two function regions of the operating panel preferably are repositionable between two respective operating positions, where the two modules, at least in some predetermined combinations of their operating positions, are arranged and spaced with respect to one another so that they can be operated simultaneously by an operator of average height in the driver's cab.

According to a preferred embodiment, each repositionable module is in each instance separable from a connection assigned to the first operating position, and having electrical connection means as well as mechanical mounting means for the module, and is electrically and mechanically connectable to a second connection assigned to the second operating position. This results in short transfer times, where transfer of the module or modules is possible in simple fashion. The connections and the modules preferably form plug-in systems with automatic mechanical safety locks.

It may be provided within the scope of the invention that each connection is connection-compatible with regard to each of the two repositionable modules, so that the variety of possible operating configurations can be still further increased.

At least one of the function regions of the operating panel, in particular the first function region, preferably contains a steering means, for example, a steering wheel, for a steerable wheel of the industrial delivery truck, while the other function region contains means for switching between forward travel and backward travel of the vehicle.

In addition, it is provided that one of the function regions, in particular the second function region, contains means for controlling vehicle speed. Additionally, at least one of the function regions, preferably the second function region, contains means for controlling the lift of the load-carrying means.

For an industrial delivery truck in which the driver's cab is vertically movable together with the load-carrying means on the lifting framework and in which the load-carrying means in addition is controlled vertically movable relative to the driver's cab, at least one of the function regions, preferably the second function region, has means for controlling common lift of the driver's cab and the load-carrying means, as well as means for controlling the motion of the load-carrying means relative to the driver's cab. The lifting function operating means may be combined with an actuating element or a plurality of actuating elements. Operating elements optionally may be equipped with switchable double functions.

An industrial delivery truck, in particular a pickup-and-delivery device, is proposed in accordance with an additional aspect of the invention. This is designed as a vehicle having a steerable travel mechanism, a driver's cab controlled vertically movable on a lifting framework, a load-carrying means, vertically movable on the lifting framework together with the driver's cab, on the side of the driver's cab lying in front in the longitudinal direction of the vehicle, which additionally is controlled vertically movable relative to the driver's cab, and a first operating panel, to be actuated from the driver's cab, for controlling the travel mechanism and lifting functions of the load-carrying means including the vertical position of the driver's cab, the first operating panel being arranged in a rear region of the driver's cab in the longitudinal direction of the vehicle and having at least two function regions, a first one of which is provided for operation chiefly by the left hand and a second one of which is provided for operation chiefly by the right hand of an operator in the driver's cab. According to the invention, this industrial delivery truck is characterized in that a second operating panel is provided in a front region of the driver's cab in the longitudinal direction of the vehicle, the second operating panel containing operating elements for controlling the vertical motion of the load-carrying means relative to the driver's cab.

The two operating panels preferably are arranged and spaced with respect to one another so that one of the two function regions of the first operating panel and a function region of the second operating panel are actuable simultaneously by an operator of average height standing in the driver's cab, positioned transverse to the longitudinal direction of the vehicle.

According to an especially preferred embodiment, the second operating panel may be provided with operating functions corresponding to one of the function regions of the first operating panel.

BRIEF DESCRIPTION OF THE DRAWINGS

For a better understanding of the invention, reference may be made to the following description of preferred embodiments thereof taken in conjunction with the accompanying drawings, in which.

In the drawings, like reference numerals are used to designate like components, but increased by 100 from embodiment to embodiment for clarity.

DETAILED DESCRIPTION

Figure 1:
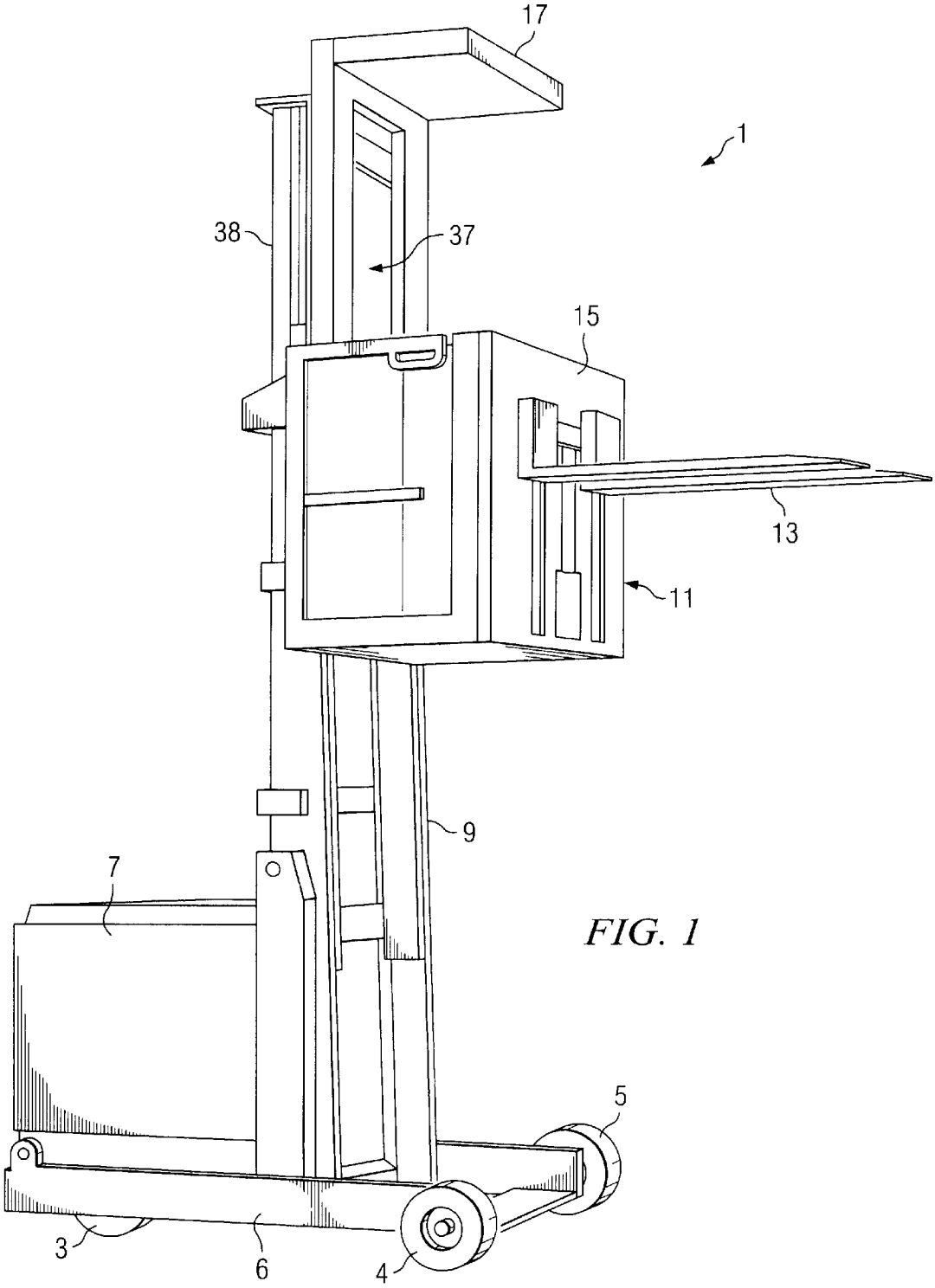
FIG. 1 shows, in a simplified representation, a perspective view of an industrial delivery truck according to the invention.

The type of industrial truck shown in FIG. 1 is a so-called pickup-and-delivery device 1 with an undercarriage 6 supported on three wheels 3, 4, 5. The wheel 3 is steerable.

Under the cover 7 in the rear region of the pickup-and-delivery device 1 are located the electric motor travel mechanism, the batteries for electrical supply and hydraulic components for the drive of a driver's cabin 11, which is vertically displaceable on the lifting framework 9, and a load-carrying means 13 projecting forward from the driver's cabin 11, which is hydraulically displaceable vertically together with the driver's cabin 11 on the lifting framework and additionally relative to the driver's cabin 11.

The driver's cabin has a breastwork 15 at its front end, over which the operator standing in the driver's cabin has access to the load-carrying means 13 or to a pallet (not shown) carried by the load-carrying means 13, for setting down goods removed from a shelf, for example.

In an alternative embodiment, the load-carrying means 13, shown as a pair of forks in FIG. 1, could be replaced by a walkable load-carrying means. In such a variant, the breastwork 15 could have a passage for the operator.

Figure 2:
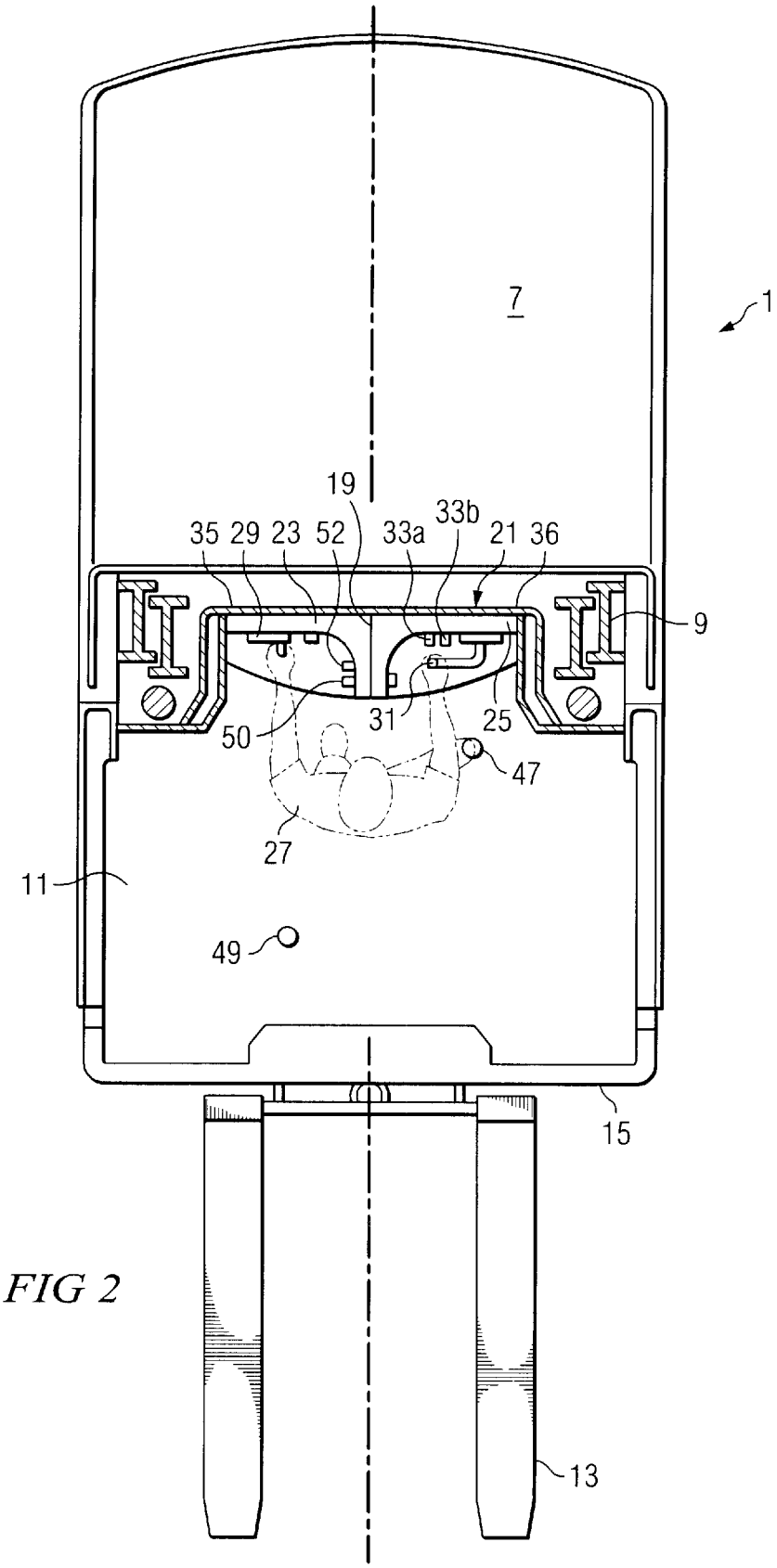
FIGS. 2–4 are schematic top views of the industrial delivery truck according to FIG. 1, showing alternative operating positions of the operating-panel module(s)

In the schematic top view of FIG. 2, in which, for clarity of illustration, the protective roof 17 of the driver's cabin 11 seen in FIG. 1 is not shown and the mast region is represented in section, an operating panel 19 can be seen on the rear wall 21 of the driver's cabin 11. The operating panel 19 comprises two consoles or modules 23 and 25, physically separable from one another if necessary. The first module 23, arranged at the rear on the left in the driver's cabin in FIG. 2, is designed for operation with the left hand, and the second module 25, arranged at the rear on the right in the driver's cabin 11 in FIG. 2, is designed for operation with the right hand of an operator 27 standing in the driver's cabin 11 with his back to the load-carrying means 13.

In the case of the example of FIG. 2, the first module 23 of the operating panel 19 has as operating element a steering wheel 29 for controlling the steering position of the steered wheel 3 (FIG. 1). The second module 25 of the operating panel 19 has operating elements 31 for controlling the travel mechanism, in particular for switching between forward travel and backward travel, as well as for controlling travel speed, and in addition has operating elements 33*a*, 33*b* for controlling the lifting functions of the load-carrying means 13, in particular for controlling the common lifting motion of the driver's cabin 11 and the load-carrying means 13. Optionally, the second module 25 may have a multiple-function operating element, such as a joystick, with which a plurality of operating functions can be controlled. All of the operating elements may be conventional.

Arrangement of the operating panel 19 in the rear region of the cabin 11, as shown in FIG. 2, may be expedient for reasons of ergonomics and safety in travel operation, in the event that in the typical use of the pickup-and-delivery device 1 long stretches are to be covered without interruption more frequently in backward travel operation than in forward travel operation. Such a situation exists, for example, when the operator, by stepwise forward travel, approaches particular shelf positions in an aisle of shelves in order to remove particular goods from the shelf after corresponding vertical adjustment of the cabin 11 and the load-carrying means 13 on the lifting frame 9 and assemble a pickup, and then, after completion of the pickup, the pickup-and-delivery device 1 in the aisle of shelves is driven backward without intermediate stops to an unloading station, for example in the entrance to the aisle of shelves, in order to unload the goods carried on the load-carrying means 13. The arrangement of the operating panel 19 of FIG. 2 is also advisable when the load-carrying means 13 is loaded with objects or goods that, viewed from the driver's cabin, obstruct the view ahead. The cabin 11 and the lifting framework 9 have open viewing regions 37, 38 (FIG. 1), through which the operator 27 can look in the backward direction of the vehicle 1.

The modules 23 and 25 are arranged at connections 35 and 36, respectively, where each connection 35 and 36 has electrical connection means (not shown) and mechanical mounting means (not shown). The connections 35 and 36 preferably are constructed such that the correct electrical connections and mechanical fastening and securing connections of the modules 23 and 25 are automatically effected, for example by detachable catch means. The electrical and mechanical connections may be conventional.

Figure 3:
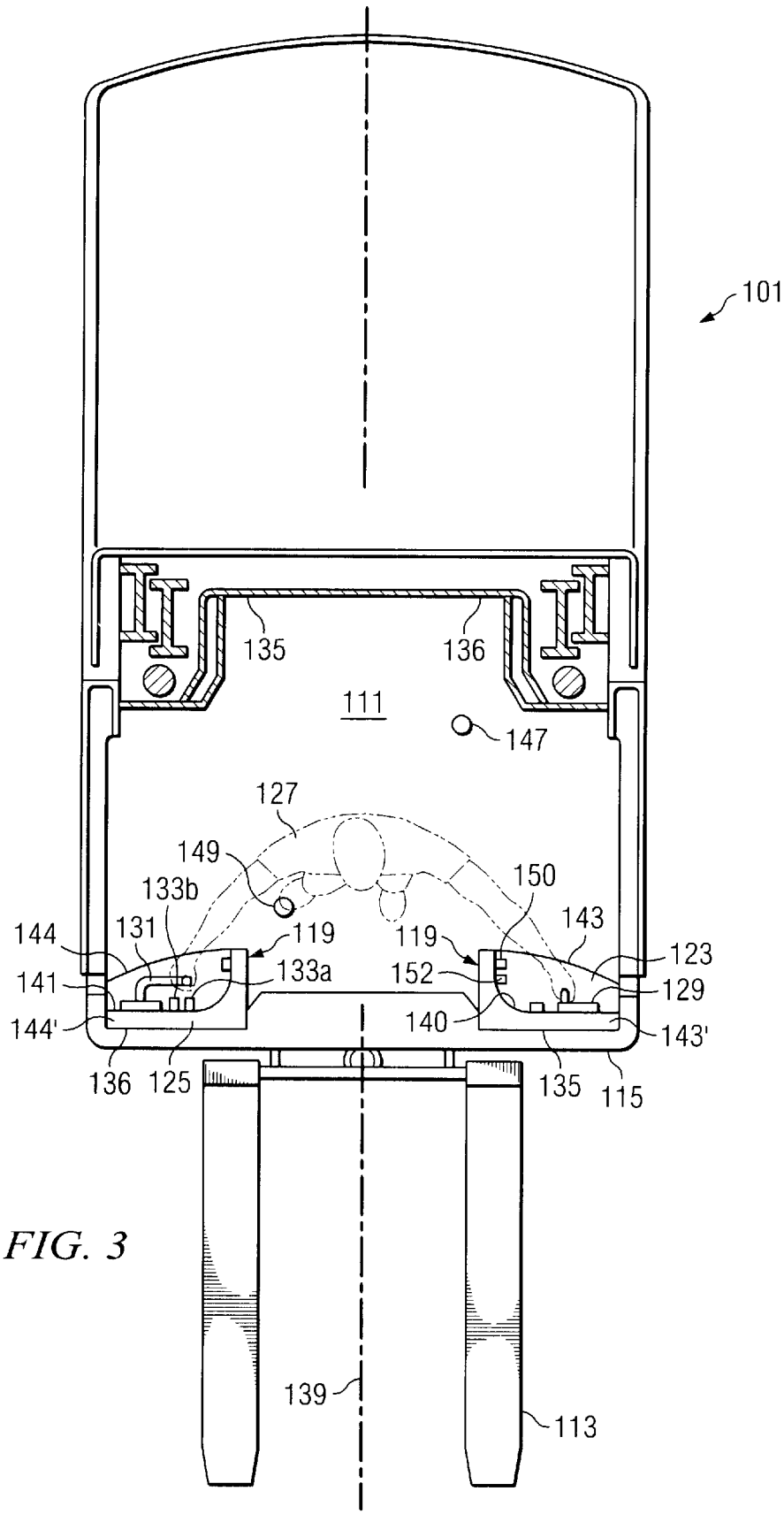

FIG. 3 shows the modules 123 and 125 of the operating panel 119 after repositioning to respective second operating positions at the front breastwork 115 of the driver's cabin 111, specifically at connections 135 and 136, which are designed to correspond to the connections 35 and 36. In the arrangement of the operating panel 119 of FIG. 3, the operator 127 works in a posture oriented to the load-carrying means 113.

Arrangement of the modules 123 and 125 in the front region of the driver's cabin 111 of FIG. 3 may be expedient if, in typical use of the pickup-and-delivery device 101, long stretches are to be covered without interruption more frequently in forward travel operation than in backward travel operation or if the device 101 is operated more frequently in forward travel operation than in backward travel operation.

The arrangement of the modules 123 and 125 shown in FIG. 3, each at a respective horizontal distance from the midplane 139 of the pickup-and-delivery device 101, makes it possible for the operator 127, without hindrance by operating elements, to bend over a greater average region of the breastwork 115 to the load-carrying means 113, in order to take goods from a shelf or the like. In addition, it can be seen in FIG. 3 that all operating elements 129, 131, 133 are arranged in a recess or depression 140, 141 on the respective modules 123 and 125. There, the operating elements 129, 131, 133 do not project outward beyond a lower wall region 143, 144 or beyond an upper wall region 143', 144' of the respective modules 123 and 125, so that they fit into a protected position and do not obstruct the operator 127 upon loading of the load-carrying means 113 from the driver's cabin 111.

In a variant (not shown) of the industrial truck according to the invention with an arrangement of the modules 123 and 125 at a horizontal distance apart from one another according to FIG. 3, a passage from the driver's cabin to the load-carrying means is provided between the modules 123, 125.

Figure 4:
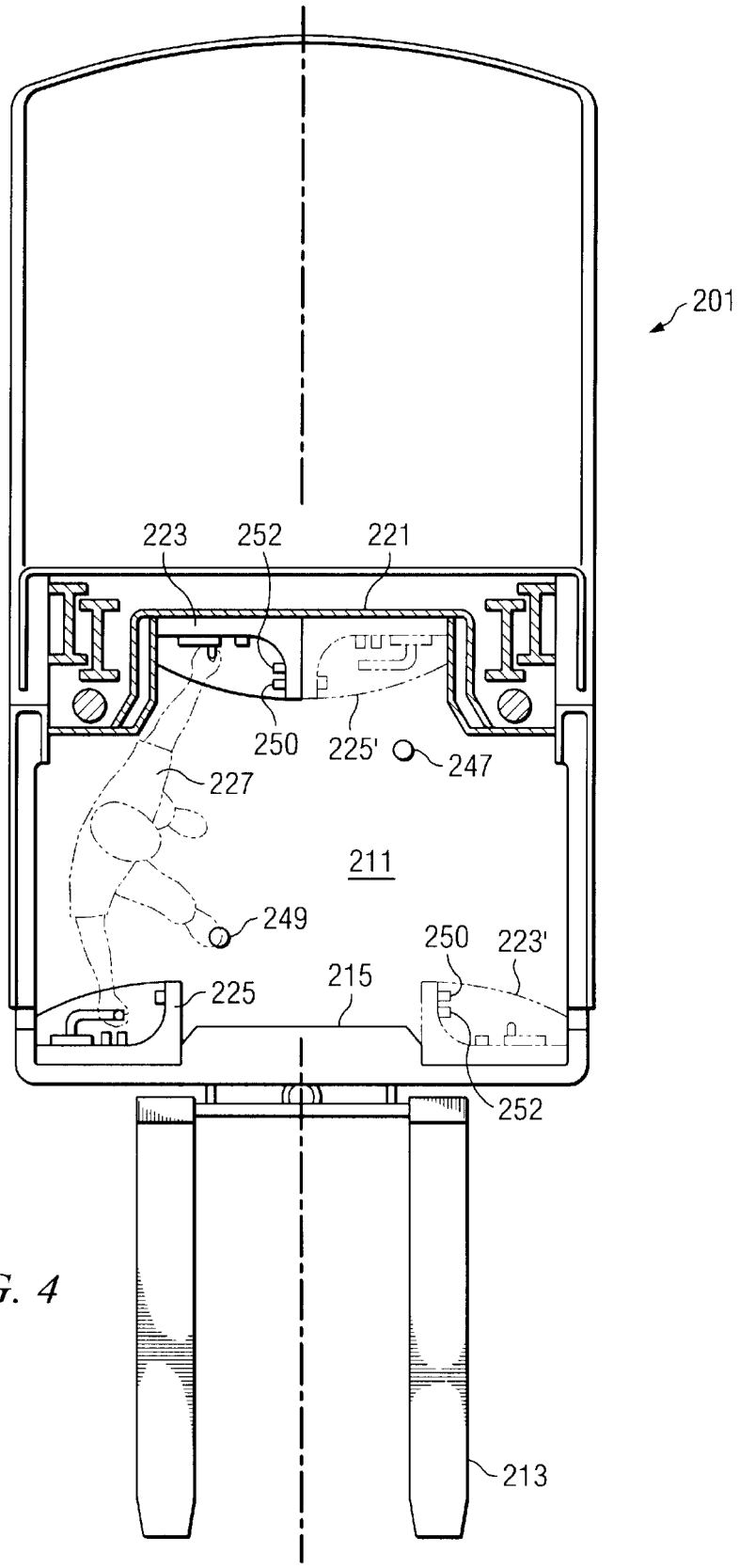

A very interesting possibility for arrangement of the modules 223 and 225 is shown in FIG. 4.

In FIG. 4, a module, in the case of the embodiment the second module 225, is located in its operating position, shown in FIG. 3, at the front breastwork 215 and the other module, in the case of the embodiment of the first module 223, is in the operating position, shown in FIG. 2, at the rear wall 221 of the driver's cabin. The operator 227, standing facing essentially transverse to the direction of travel or the forward-backward direction, can actuate operating elements of the first module 223 with his left hand and operating elements of the second module 225 with his right hand. The arrangement of the modules 223 and 225 shown in FIG. 4 can be very advantageous, for example, if in the typical use of the pickup-and-delivery device 201 frequent switching between forward travel operation and backward travel operation takes place, perhaps in searching runs in an aisle of shelves (not shown) along a shelf facing the operator. As indicated at 223' and 225' in FIG. 4, the modules may alternatively be arranged at the other side of the cabin 211. In addition, one or both of the modules 23, 25; 123, 125 and 223, 225 may be provided in duplicate, so that combinations of the arrangement of the modules 23, 123, 223 and 25, 125, 225 shown in FIGS. 2–4 are permanently available without repositioning of modules 23, etc. and/or 25, etc.

In FIGS. 2–4, foot switches, which are designed as so-called dead man's switches, are shown at 47, 127, 227 and 49, 149, 249. Travel operation and lifting operation of the pickup-and-delivery device 1, 101 and 201 are unblocked only when a respective foot switch 47, etc. or 49, etc. is depressed. The switches 47, etc., and 49, etc., are positioned so that in each instance one of them can be depressed with a foot by the operator in the respective posture of the operator of FIGS. 2–4.

It is to be added that, at the first module 23, 123, 223, a key 50, 150, 250 may be provided for so-called free-hand safety operation. Travel operation of the pickup-and-delivery device 1, 101, 201 but not lifting operation of the cabin 11, 111, 211 and of the load-carrying means 13, 113, 213 is possible in the unpressed state of the key 50, 150, 250. The lifting function operating elements 33, 133, 233 of the second module 25, 125, 225 are then switched off.

When the key 50, 150, 250 is pressed, travel operation of the pickup-and-delivery device 1, 101, 201 is prevented, but lifting operation of the driver's cabin 11, 111, 211 and of the load-carrying means 13, 113, 213 is possible.

In the embodiments of FIGS. 2–4, there is additionally provided on the first module 23, 123, 223 a lifting-function selection switch or key 52, 152, 252, which may be actuated together with the key 50, 150, 250 with one hand. The switches 50, 150, 250 and 52, 152, 252 may alternatively be combined in a common operating element. In a first position of the lifting-function selection switch 52, 152, 252, an electronic control means (not shown) engages the lifting function operating elements 33, 133, 233 on the second module 25, 125, 225 having the functions of raising and lowering the driver's cabin 11, 111, 211 together with the load-carrying means 13, 113, 213 (main lift) arranged thereon. In a second switch position of the lifting-function selection switch 52, 152, 252, the control means engages the lifting function operating elements 33, 133, 233 having the functions of raising and lowering of the load-carrying means 13, 113, 213 relative to the driver's cabin 11, 111, 211 (supplementary lift).

Figure 5:
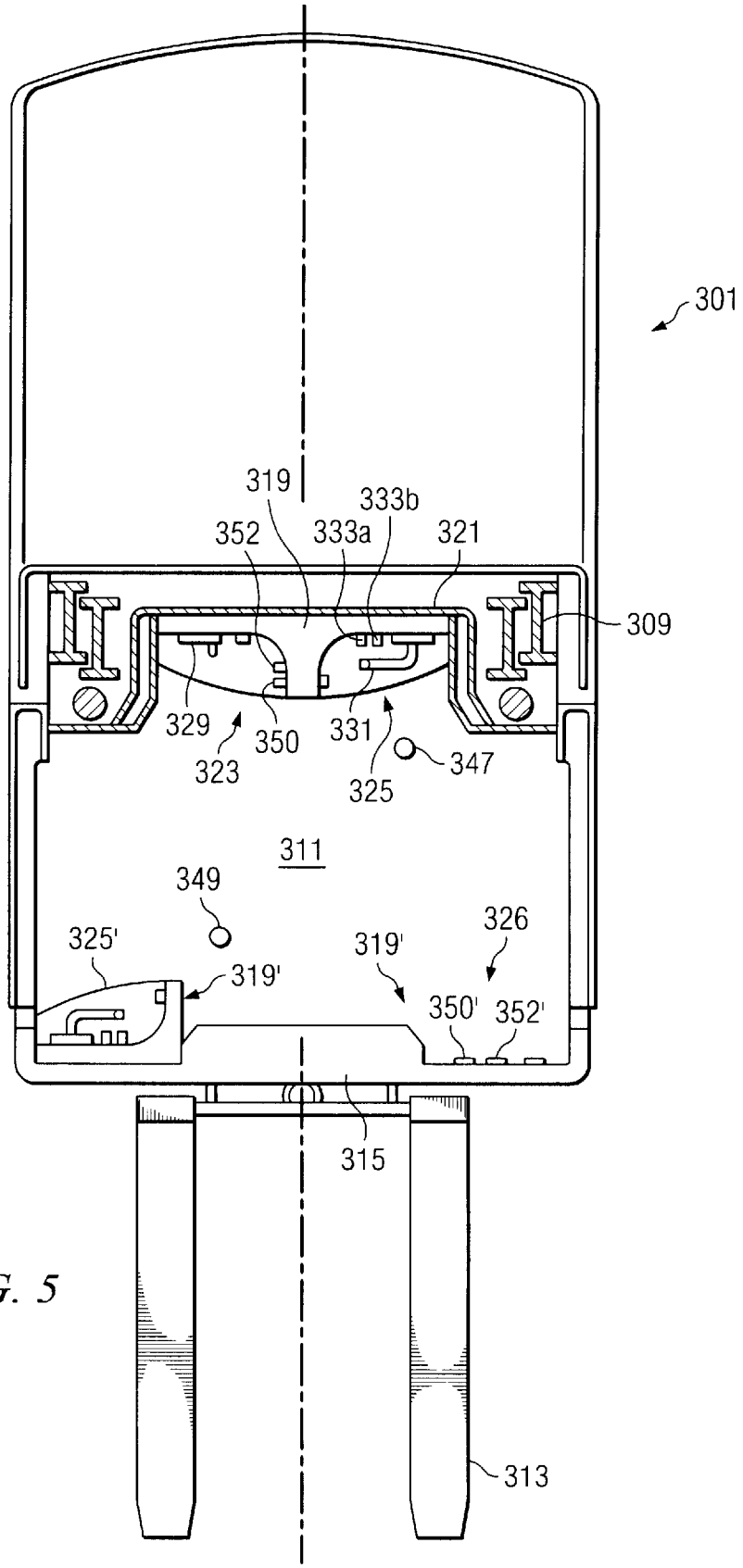
FIGS. 5–6 are schematic top views similar to FIGS. 2–4, but showing additional embodiments of the invention.

An additional principal aspect of the invention is explained below with reference to the embodiment of FIG. 5. FIG. 5, in a top view similar to that of FIGS. 2–4, shows a pickup-and-delivery device 301 that has substantially the design shown in FIG. 1. A first operating panel 319 with a function region 323 for operation with the left hand and a second function region 325 for operation with the right hand of an operator standing positioned in the cabin 311 to the rear of the pickup-and-delivery device 301 is arranged at the rear wall 321 of the driver's cabin 311. Unlike the examples previously described, the operating panel 319 may be installed fixed. The function of the operating elements 329, 331, 333*a*, 333*b*, 350 and 352 preferably corresponds to the function of the operating elements 31, 33*a*, 33*b*, 50 and 52 of the embodiments of FIGS. 2–4.

A second operating panel 319' with function regions 325' and 326 is arranged at the front breastwork 315 of the driver's cabin 311. The same operating functions are assigned to the function region 325' as to the function region 325. The function region 326 has a two hand-operation safety switch 350' and a lifting-function selection switch or key 352'.

The following operating possibilities, depending upon the posture or position of an operator in the driver's cabin 311, are provided:

a) The operator stands positioned towards the rear of the pickup-and-delivery device 301 and with his left hand operates the function region 323 and with his right hand operates the function region 325, depressing the foot switch 347 with his right foot. In this operating configuration, alternately steered travel operation or lifting operation of the driver's cabin 311 and optionally supplementary lifting operation of the load-carrying means 313 relative to the driver's cabin 311 are possible.

b) The operator stands facing transverse to the longitudinal direction of the vehicle and actuates the function region 323 with his left hand and the function region 325' with his right hand, depressing the foot switch 349 with his right foot. In this operating configuration, the same operating functions as indicated above under a) are possible.

c) The operator stands oriented towards the front breastwork 315 and with his right hand operates the function region 325' and with his left hand the function region 326, depressing the foot switch 349 with his right foot. In this operating configuration, alternately unsteered travel operation or lifting operation of the driver's cabin 311 or the load-carrying means 313 relative to the driver's cabin 311 is possible. Unsteered travel operation takes place, for example, in guided travel of the pickup-and-delivery device in an aisle of shelves.

Figure 6:
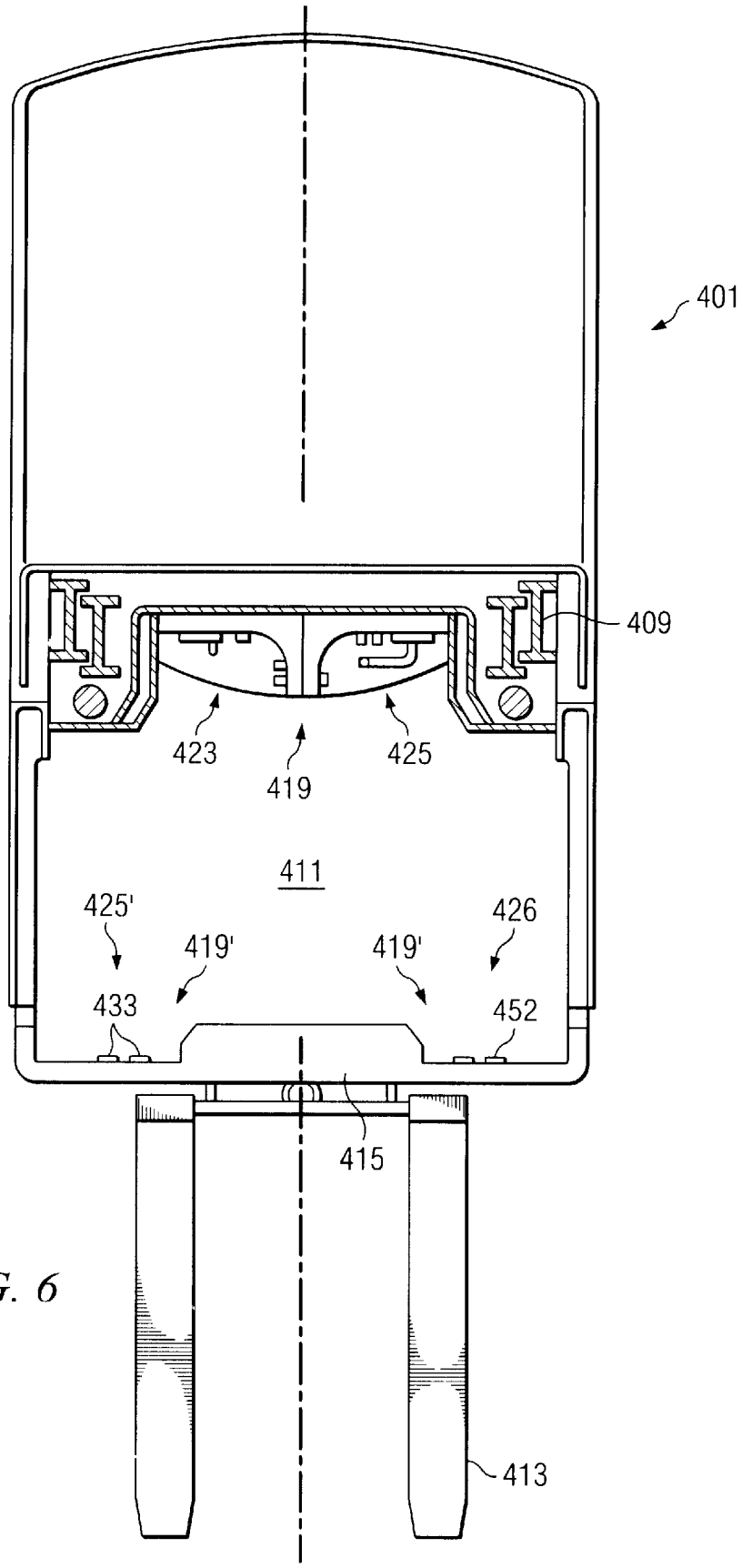

The embodiment represented in FIG. 6 differs from that of FIG. 5 in that the second operating panel 419' is modified at the front breastwork 415. The function region 425' has operating elements 433 for the lifting functions of raising and lowering of the driver's cabin 411 and/or of the load-carrying means 413 relative to the driver's cabin 411. The function region 426 has a lifting-function selection switch 452, which assigns the operating elements 433 either to the main lift (driver's cabin 411) or to the supplementary lift (load-carrying means 413 relative to the driver's cabin).

The invention is not limited to the assignment of functions or operating elements described in the examples to the operating function regions described. The operating function regions may optionally be engaged with other combinations of operating functions and optionally have additional operating functions.

What is claimed is:

1. In an industrial delivery truck of the pickup-and-delivery type comprising a vehicle having a controllable travel mechanism, a load-carrying means controlled vertically movable on a lifting framework, a driver's cab including an operating panel, to be operated from the driver's cab, for controlling the travel mechanism and lifting functions of the load-carrying means, the operating panel having at least two function regions, a first one of which is provided for operation chiefly by the operator's left hand and a second one of which is provided for operation chiefly by the operator's right hand, the improvement comprising:

the two function regions of the operating panel being configured as first and second modules that are separable from one another, at least the first of which is located in the access region of the driver's cab and is repositionable, separately from the second module between at least two operating positions from one side of the driver's cab to another side of the driver's cab and is capable of functional use in each of said operating positions.

2. The industrial delivery truck according to claim 1, wherein the load-carrying means is arranged in front on the driver's cab in the horizontal longitudinal direction of the vehicle, at least the first module, in a first operating position, is arranged in a rear region of the driver's cab in said longitudinal direction of the vehicle and, in a second operating position, is arranged in a front region of the driver's cab in said longitudinal direction of the vehicle.

3. The industrial delivery truck according to claim 1 or 2, wherein at least the first module is repositionable between a particular first operating position and a particular second operating position, the two modules, at least in certain predetermined combinations of their operating positions, being arranged and spaced with respect to one another so that they can be operated simultaneously by an operator of average height in the driver's cab.

4. The industrial delivery truck according to claim 3, wherein each repositionable module is in each instance separable from a connection assigned to the first operating position and having electrical connection means and mechanical mounting means for the module and is electrically and mechanically connectable to a second connection assigned to the second operating position, said second connection having electrical connection means and mechanical mounting means for the module.

5. The industrial delivery truck according to claim 3, wherein the modules may be selectively arranged with respect to one another in the following operating positions:

a) both modules are positioned in a front region of the driver's cab in the horizontal longitudinal direction of the vehicle, the module assigned to the first function region, viewed from the driver's cab, being arranged at the left front and the module assigned to the second function region being arranged at the right front;

b) one of the modules is positioned in a front region of the driver's cab in said longitudinal direction of the vehicle and the other module is positioned in a rear region of the driver's cab in said longitudinal direction of the vehicle, and c) the two modules are arranged in a rear region of the driver's cab in the longitudinal direction of the vehicle, the module assigned to the first function region, viewed from the driver's cab, being arranged at the left rear and the module assigned to the second function region being arranged at the right rear.

6. The industrial delivery truck according to claim 1, wherein at least one of the function regions of the operating panel contains a steering means for at least one steerable wheel of the vehicle and the other function region of the operating panel contains means for switching between forward travel and backward travel of the industrial delivery truck.

7. The industrial delivery truck according to claim 6, wherein at least one of the function regions of the operating panel contains means for controlling travel speed.

8. The industrial delivery truck according to claim 6 or 7, wherein at least one of the function regions of the operating panel contains means for controlling the lift of the load-carrying means.

9. The industrial delivery truck according to claim 6, wherein the driver's cab is vertically displaceable on the lifting framework together with the load-carrying means, the load-carrying means additionally is mounted for controlled vertical movement relative to the driver's cab, and at least one of the modules contains means for controlling the common lift of the driver's cab and the load-carrying means as well as means for controlling the motion of the load-carrying means relative to the driver's cab.

* * * * *

UNITED STATES PATENT AND TRADEMARK OFFICE

CERTIFICATE OF CORRECTION

PATENT NO. : 6,564,906 B1
DATED : May 20, 2003
INVENTOR(S) : Haack et al.

It is certified that error appears in the above-identified patent and that said Letters Patent is hereby corrected as shown below:

Title page,
Item [63], Related U.S. Application Data, "filed on Nov. 11, 1998" should read -- filed on Nov. 9, 1998 --

Signed and Sealed this

Fourth Day of January, 2005

JON W. DUDAS
*Director of the United States Patent and Trademark Office*